US005254454A

United States Patent [19]

Mimiya et al.

[11] Patent Number: 5,254,454

[45] Date of Patent: Oct. 19, 1993

[54] METHOD OF PREPARING SILVER HALIDE GRAINS FOR PHOTOGRAPHIC EMULSION AND LIGHT SENSITIVE MATERIAL CONTAINING THE SAME

[75] Inventors: Chikao Mimiya; Satoshi Ito; Haruhiko Masutomi; Kazuyoshi Ichikawa, all of Tokyo, Japan

[73] Assignee: Konica Corporation, Tokyo, Japan

[21] Appl. No.: 13,192

[22] Filed: Jan. 29, 1993

Related U.S. Application Data

[63] Continuation of Ser. No. 793,098, Nov. 15, 1991, abandoned.

[30] Foreign Application Priority Data

Nov. 19, 1990 [JP] Japan ..... 2-314891

[51] Int. Cl.[5] ..... G03C 1/015

[52] U.S. Cl. ..... 430/569; 430/567; 430/568

[58] Field of Search ..... 430/567, 568, 569, 948

[56] References Cited

U.S. PATENT DOCUMENTS 4,379,837 4/1983 Lapp et al. ..... 430/568
5,035,991 7/1991 Ichikawa et al. ..... 430/569
5,173,398 12/1992 Fukazawa et al. ..... 430/569

*Primary Examiner*—Charles L. Bowers, Jr.
*Assistant Examiner*—Mark F. Huff
*Attorney, Agent, or Firm*—Finnegan, Henderson, Farabow, Garrett & Dunner

[57] ABSTRACT

A method of preparing silver halide grains for a photographic emulsion which has a constant mass production qualities and a controlled crystalization technique is disclosed. The first reaction of halides and silver is performed in a mixer with a blades of high speed then the fine crystals of silver halide are kept in an adjusting vessel where monitoring and control devices are provided and the fine crystals are supplied to a parent tank for ripening the crystals prepared in the parent tank.

11 Claims, 2 Drawing Sheets

METHOD OF PREPARING SILVER HALIDE GRAINS FOR PHOTOGRAPHIC EMULSION AND LIGHT SENSITIVE MATERIAL CONTAINING THE SAME

This application is a continuation of application Ser. No. 07/793,098 filed Nov. 15, 1991, now abandoned.

FIELD OF THE INVENTION

The present invention relates to a method of preparing silver halide grains for a photographic emulsion (hereinafter referred to as silver halide emulsion grains), as well as to a silver halide photographic light-sensitive material containing these grains. More specifically, this invention relates to a method of preparing silver halide emulsion grains which each have a uniform halide composition, contain substantially no reduced silver, and do not differ greatly from each other in halide composition.

BACKGROUND OF THE INVENTION

Generally, silver halide grains are formed by allowing an aqueous silver salt solution and an aqueous halide solution to react in a reactor in the presence of an aqueous colloid solution. Two methods are known: (1) the single-jet method (hereinafter abbreviated as the SJ method) in which an aqueous silver salt solution is added with stirring to the mixture of a protective colloid (e.g. gelatin) and an aqueous halide solution for a prescribed period of time; and (2) the double-jet method (hereinafter abbreviated as the DJ method) in which an aqueous halide solution and an aqueous silver salt solution are added to an aqueous protective colloid solution for a prescribed period of time Advantages of the DJ method over the SJ method are that the silver halide grains with a narrower size distribution can be obtained and that the halide compositions of grains can be changed freely during their growth.

It is known that the growth rate of silver halide grains greatly depends on such factors as the silver (or halide) ion concentration of a reaction liquid, the concentration of a solvent for a silver halide, the distance between grains and the size of grains. If silver (or halide) ions are present in a reactor unhomogeneously, the grain growth rate may vary from grain to grain, resulting in the formation of silver halide grains lacking uniformity. To obtain silver halide grains being uniform in size, crystal structure, halide composition and other factors, it is important to allow an aqueous silver salt solution and an aqueous halide solution to react rapidly in an aqueous colloid solution (a parent liquid where formation, growth, and adjustment of emulsion grains will be performed) by mixing them uniformly. According to conventional methods, an aqueous halide solution and an aqueous silver salt solution are added to the surface of a parent liquid that has been put in a tank. In these methods, the concentrations of silver and halide ions tend to be higher in the vicinity of the inlets for these solutions than other places of the tank, and therefore, it is almost impossible to prepare silver halide grains being uniform in properties. To solve this problem, U.S. Pat. Nos. 3,415,650, 3,692,283 and British Patent No. 1,323,464 each propose a method which comprises supplying an aqueous halide solution and an aqueous silver salt solution to an oval, rotating mixer provided in a parent liquid tank through a pipe from its upper and lower open ends, allowing them to react rapidly by mixing them vigorously, thereby forming silver halide grains, and discharging the formed silver halide grains to the parent liquid tank by using a centrifugal force generated by the rotation of the mixer.

Japanese Patent Examined Publication No. 10545/1980 discloses a method comprising immersing a rectifying cylinder in a parent liquid tank, supplying reaction liquids separately to the cylinder from the bottom thereof, mixing the liquid vigorously with a turbine blade provided at the lower part of the cylinder, thus forming silver halide grains, and discharging the formed silver halide grains to the parent liquid tank from the opening provided at the upper part of the cylinder.

Japanese Patent Publication Open to Public Inspection (hereinafter referred to as Japanese Patent O.P.I. Publication) No. 92523/1982 discloses a method comprising immersing a mixer in a parent liquid tank, supplying an aqueous halide solution and an aqueous silver salt solution separately to the mixer, diluting these solutions with the parent liquid, and mixing them vigorously with shearing, thus forming silver halide grains.

By these conventional methods, though silver and halide ions can be distributed uniformly in a parent liquid tank, uniform distribution of these ions in a mixer cannot be realized. In a mixer, silver and halide ions tend to gather around the nozzles from which an aqueous silver salt solution and an aqueous halide solution are injected, the bottom of the mixer, or the stirring blade. Silver halide grains which are supplied with protective colloid to a mixer in which silver and halide ions are present unhomogeneously cannot grow at the same rate. Such difference in growth rate inevitably results in the formation of silver halide grains which differ from each other in size, halogen composition and other properties.

To overcome the drawback accompanying the above methods,proposed was a method that comprises supplying an aqueous silver salt solution and an aqueous halide solution to a mixer provided outside a parent liquid tank, mixing them vigorously to form silver halide grains, and supplying the formed grains to the parent liquid tank. For instance,Japanese Patent O.P.I. Publication No. 37414/1978 and Japanese Patent Examined Publication No. 21045/1973 each disclose a method which comprises circulating a parent liquid, supplying an aqueous silver salt solution, an aqueous halide solution and the parent liquid in a mixer provided in the middle of the parent liquid circulating line, mixing them vigorously in the mixer, while maintaining the ununiformity of the reaction system. Similar methods are disclosed in U.S. Pat. No. 3,897,935 and Japanese Patent O.P.I.Publication No. 47397/1978. In any of the above methods, the flow rate of the circulating parent liquid and the stirring efficiency of the mixer can be changed separately, thus enabling silver halide grains to be grown with silver and halide ions being distributed uniformly. These methods,however, are still defective in that silver halide grains supplied from the parent liquid tank to the mixer together with the parent liquid are caused to grow rapidly in the vicinity of the inlets for the aqueous silver salt solution and the aqueous halide solution. It means that, even by these methods, it is impossible to prevent perfectly the concentration of silver or halide ions from getting higher in the vicinity of the reaction liquid inlets or the stirring blade of the mixer.

To attain uniform distribution of silver and halide ions in a parent liquid, Japanese Patent O.P.I. Publication Nos.65925/1973, 88017/1976, 153428/1977, 99751/1987, J. Col. Int.Sci. 63 (1978) No. 1, page 16 and P.S.E. 28 (1984) No. 4,page 137 each describe a method in which silver halide grains that have been prepared separately are added to silver halide grains to be grown, allowing them to undergo the Ostwald' ripening. This method, however, has such a problem that, since the sizes of the silver halide grains to be added aren't small enough as compared with those of the grains to be grown, a lot of time is required for the completion of the Ostwald's ripening. By this method, growing of silver halide grains takes a prolonged period of time, resulting in high production cost and poor productivity.

As methods for forming silver halide fine grains, Japanese Patent O.P.I. Publication Nos. 183417/1989,183645/1989, Wo Nos. 89-06830 and 89-06831 each disclose a method in which silver halide fine grains are formed in a mixer provided outside a parent liquid tank, and immediately after their formation, the fine grains are supplied to the parent liquid tank. By this method, it is possible to obtain silver halide fine grains using relatively thin solutions of a silver salt and a halide. However, when use are made of thick solutions of a silver salt and a halide, since these solutions are allowed to collide with each other in a mixer by stirring, there may arise such a problem that even a small change in the flow rates of these solutions may be attended by a considerable change in pAg, i.e., silver ion concentration. Another problem accompanying this method is that, at some pAg values, silver halide fine grains with reduced silver nuclei tend to be formed in the mixer. These fine grains., when supplied to the parent liquid tank, arere-dissolved into silver and halide ions, and incorporated into growing grains together with their reduced silver nuclei. As a result, some of the emulsion grains formed by this method contain reduced silver nuclei, which may cause a photographic image obtained by using these emulsions to be fogged.

Still another defect of the above method is that, when the growth rate of silver halide grains is changed according to the scale of the preparation of an emulsion or the ingredients employed, the flow rates of an aqueous silver salt solution and an aqueous halide solution must also be changed to obtain a prescribed amount of fine grains. This leads to the formation of silver halide fine grains differing in size.

SUMMARY OF THE INVENTION

One object of the invention is to provide a method of preparing highly-sensitive and fogging-resisting silver halide grains which each have a uniform halogen composition and do not differ greatly from each other in size, crystal structure, halogen composition and other properties.

Another object of the invention is to provide a silver halide photographic light-sensitive material containing such silver halide grains.

Figure 1:
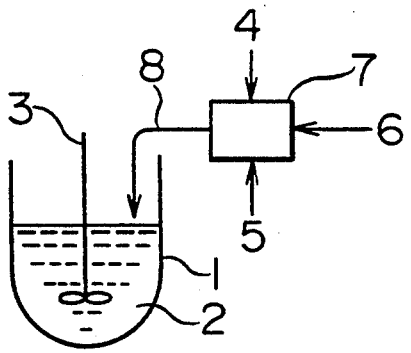
FIG. 1 PRIOR ART
FIG. 1 is a diagrammatical view of an apparatus conventionally employed for the preparation of silver halide grains.

1. . . Parent liquid tank 2. . . Aqueous protective colloid solution 3. . . Stirrer 4, 5, 6. . . Reaction liquid addition line A, B, C. . . Solution tank 7. . . Mixer 8. . . Emulsion transportation line 9. . . Adjustment vessel 10. . . Reaction chamber 11. Monitor 12. Stirring blade 13. Adjustment liquid 14. Liquid Supply and 15. Liquid Flow Control.

DETAILED DESCRIPTION OF THE INVENTION

The above objects can be attained by (1) a method of preparing silver halide grains for a photographic emulsion which comprises: mixing an aqueous silver salt solution, an aqueous halide solution and an aqueous colloid solution in a mixer provided outside a parent liquid tank in which growing of silver halide grains is to be performed, thus forming an emulsion of silver halide fine crystals, transferring said emulsion to an adjustment vessel to adjust its liquid conditions, storing said emulsion in said vessel for a prescribed period of time, and supplying said emulsion to the parent liquid tank; and (2) a silver halide photographic light-sensitive material comprising a support and provided thereon at least one silver halide emulsion layer, wherein said at least one silver halide emulsion layer contains silver halide grains formed by the method as herein described.

In the present invention, a parent liquid is defined as a liquid phase in which silver halide emulsion grains are allowed to grow and adjusted to have prescribed shapes and characteristics; nucleic grains are defined as silver halide solid phases which form the basis for the growth of emulsion grains; silver halide fine crystals are defined as silver halide solid phases which serve as a silver halide replenisher; silver halide emulsion grains are defined as silver halide solid phases formed by the supply of silver halide fine crystals to nucleic grains, which are sensitive to light, and hence capable of forming a photographic image.

In the present invention, silver halide fine crystals are formed in a mixer provided outside a parent liquid tank by either the triple-jet method (hereinafter abbreviated as the TJ method) or the protective double-jet method(-hereinafter abbreviated as the p-DJ method). In the former method, an aqueous silver salt solution, an aqueous halide solution and an aqueous protective colloid solution are mixed simultaneously, while in the latter method, an aqueous silver salt solution and an aqueous halide solution, either or both of them containing protective colloid, are added to anaqueous protective colloid solution. By these methods,silver and halide ions supplied to a mixer are fully consumed for the formation of silver halide fine crystals, and silver halide fine crystals are transferred to an adjustment vessel immediately after their formation. Therefore, unlike the conventional batch-type SJ and DJ methods, by the method of the invention, silver halide fine crystals are prevented from being consumed for both the formation of nucleic grains and the growth of emulsion grains, and hence, can be kept very fine. Further, since no solution is added to silver halide fine crystals after their formation, there is no fear of generation of a reduced silver nucleus in each crystal, which is ascribed to the presence of silver ions in a higher concentration. As a result, silver fine crystals are prevented from having fog center, leading to the formation of highly-sensitive silver halide emulsion grains.

FIG. 1 shows one example of the apparatus employed for the formation of silver halide emulsion grains. Use of this type of apparatus, however, involves problems mentioned below.

When silver halide fine crystals are formed from an aqueous protective colloid solution, an aqueous silver salt solution and an aqueous halide solution, the relationship among the flow rates of these solutions, the volume of a reaction chamber in a mixer and the length of silver halide fine crystals stay in a mixer is represented by the following equation:

$$t = \frac{V}{a + b + c}$$

V: Volume of a reaction chamber provided in a mixer (ml)

a: Flow rate of an aqueous silver salt solution (ml/min)

b: Flow rate of an aqueous halide solution (ml/min)

c: Flow rate of an aqueous protective colloid solution (ml/min)

t: Length of silver halide fine crystals stay in a mixer (min)

As compared with those employed in the conventional batch-type methods, a reaction chamber provided in this apparatus has a relatively small volume. On the other hand, to obtain a silver halide fine crystal emulsion with a higher crystal concentration, it is required to employ thick solutions of a silver salt and a halide. When the flow rate of a silver salt solution, a halide solution or a protective colloid solution changes, the conditions under which silver halide fine crystals are grown (e.g., pAg, pH, properties of protective colloid) also undergo a change. Since the mixer shown in this figure has a small volume, a change in the first change is accompanied by a change in the flow rate of a silver salt solution is considerable as compared with the case in the conventional batch-type methods. If direct transportation of a silver halide fine crystal emulsions is performed between a mixer and a parent liquid tank, the parent liquid tank must receive silver halide fine crystal emulsions differing greatly in pAg or pH. This phenomenon adversely affects the growth of silver halide grains in a parent liquid tank. Silver halide fine crystals formed at a lower pAg, i.e., at a higher silver ion concentration, tend to have reduced silver nuclei. Such reduced silver nuclei, when supplied to a parent liquid tank, become the fog center of emulsion grains.

Another defect of supplying silver halide fine crystals to a parent liquid tank immediately after their formation will be mentioned below. When silver halide fine crystals are sent to a parent liquid tank immediately after they are formed in a mixer, the silver halide fine crystals must be supplied in an amount which is in compliance with the rate of the Ostwald's ripening in a parent liquid tank. The amount of silver halide fine crystals to be formed in a mixer therefore, depends on the amount required to be supplied. Under such circumstances, it is impossible to keep the flow rates of an aqueous silver salt solution, an aqueous halide solution and an aqueous protective colloid solution constant. A change in flow rates results in a change in the length of time silver halide fine crystals stay in a mixer ("t" in the above formula), resulting in a difficulty in feeding silver halide fine crystals with uniform sizes to a parent liquid tank during the growth of emulsion grains. In addition, the dissolving rate of silver halide fine crystals may change with time, and some recipes may considerably prolong the time required for the growth of emulsion grains.

The inventors made extensive studies, and have found that the above problems can be solved by transferring a silver halide fine crystal emulsion to an adjustment vessel immediately after its formation, where the conditions of the formed emulsion will be adjusted appropriately. By the employment of such adjustment vessel, it has become possible to keep the conditions of silver halide fine crystals to be supplied to a parent liquid tank constant, as well as to make the formation of silver halide fine crystals less dependent on the conditions of grain growing in a parent liquid tank,thus enabling silver halide fine crystals with uniform sizes and free of reduced silver nuclei to be formed.

Figure 2:
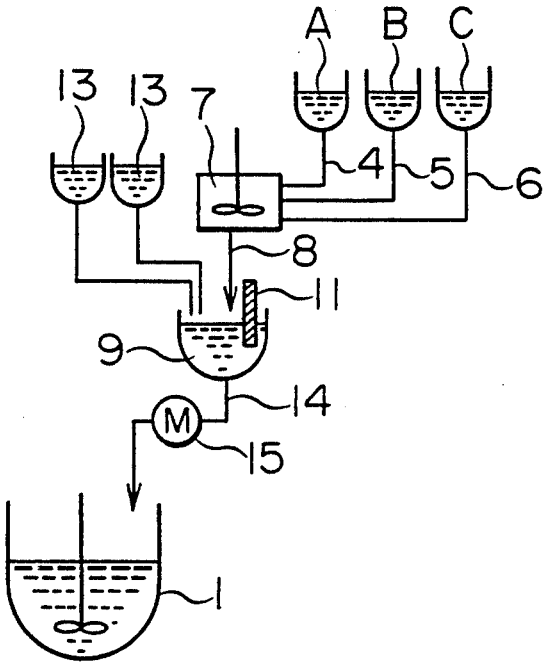
FIG. 2 is a diagrammatical view of an apparatus to be employed in the invention.
Figure 3:
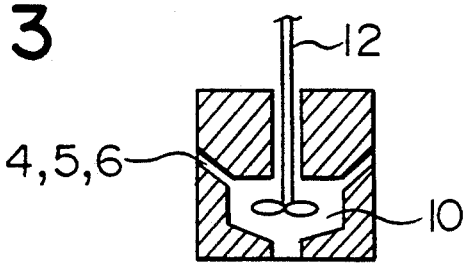
FIG. 3 is a cross-sectional view of a mixer to be employed in the invention.

FIG. 2 shows one example of apparatus to be employed in the present invention. Vessels A, B and C respectively contain an aqueous protective colloid solution, an aqueous silver nitrate solution and an aqueous halide solution. These solutions are supplied to a mixer 7 by lines 4, 5 and 6, respectively, with their flow rates being controlled. In a mixer, these solutions are rapidly and vigorously mixed, and the resultant is transferred to an adjustment vessel 9 by a transportation line 8. FIG. 3 shows the mixer in more detail. In the mixer 7, provided is a reaction chamber 10 which has a stirring blade 12. The solutions supplied to the mixer are mixed vigorously and rapidly with this blade. The rotation speed of this blade is 2,000 rpm or higher, preferably 5,000 rpm or higher, more preferably 10,000 rpm or higher. In this mixer, the formation of silver halide fine crystals cannot always be performed under the same conditions, and hence, the properties of silver halide fine crystals formed in the mixer may vary from point to point in time. To avoid this phenomenon, the adjustment vessel 9 is equipped with a monitor 11 for monitoring pAg and pH. Adjustment liquids 13 are supplied to the adjustment vessel 9. A silver halide fine crystal emulsion sent to this adjustment vessel is thus adjusted to have appropriate pAg and pH.

Silver halide fine crystals may be formed any of the acid method, the neutral method and the ammonia method. Of them, the acid method and the neutral method are preferable. Most preferable is the acid method. To prevent silver halide fine crystals from having reduced silver nuclei, pAg should be kept preferably at 3.0 or higher, more preferably at 5.0 or higher, most preferably 9.0 or higher, and pH should be 10 or less, preferably 7 or less, more preferably 4 or less and $[Ag^+][OH^-]$ is less than $10^{-10}$, preferably $10^{-15}$, and more preferably $10^{-20}$, in the mixer..

As the protective colloid, use is made of normal high molecular gelatin. Examples of suitable protective colloid are given in Research Disclosure Vol. 176, No. 17643 (December 1978), IX. A silver halide fine crystal emulsion may be kept in a mixer at a low temperature, thus preventing fine crystals from undergoing the Ostwald's ripening. However, gelatin tends to coagulate at a low temperature. To avoid this problem, in place of high molecular weight gelatin, use can be made of low molecular weight gelatin such as those described in Japanese Patent O.P.I. Publication No. 166442/1990, synthetic high molecular weight compounds which have an effect similar to that of protective colloid on silver halide grains and natural high molecular weight compounds other than gelatin. The concentration of protective colloid is 1 wt % or higher, preferably 2 wt % or higher, more preferably 3 wt % or higher.

By the method of the present invention, even when silver halide fine crystals are caused to have reduced silver nuclei due to a decrease in pAg, which is ascribable to a change in the flow rate of a silver salt solution, such reduced silver nuclei can be prevented from further growing by the adjustment performed in the adjustment vessel. Therefore, by the method of the invention, silver halide fine crystals will never cause emulsion grains to have fog center. Supply of silver halide fine crystals to the adjustment vessel is essential in the present invention. Supply of fine crystals may be performed either during or after the formation of the silver nuclei. A silver halide fine crystal emulsion, which has been adjusted to have suitable pH and pAg in the adjustment vessel, is then supplied to a parent liquid tank by an addition line 14 (e.g., a pump 15).

In a parent liquid tank, silver halide fine crystals are consumed for the growth of emulsion grains by the effect of the Ostwald's ripening. The silver halide fine crystals formed by the method of the invention, due to their extremely small sizes, can be dissolved readily in a parent liquid, re-decomposed into silver and halide ions, allowing emulsion grains in a parent liquid tank to grow uniformly. The halogen composition of a fine crystal is not critical; a crystal may consist of either one or two or more kinds of silver halide. The halogen composition of a silver halide fine crystal may be identical with that of an intended emulsion grain. The supply of a silver halide fine crystal emulsion to a parent liquid tank may be performed with flow rate control.

After supplied to a parent liquid tank, silver halide fine crystals are re-dissolved in a parent liquid, and then deposited on nucleic grains or emulsion grains already formed, thus allowing them to grow. There is a fear, however, that silver halide fine crystals themselves, due to their high solubility to a parent liquid, may undergo the Ostwald's ripening, and agglomerate with the lapse of time to become larger-sized grains. After such agglomeration, crystals can no longer be dissolved well in a parent liquid, and adversely affect the growth of emulsion grains. There is also a possibility that agglomerated crystals themselves become nucleic grains and grow.

This phenomenon can be eliminated by cooling a silver halide fine crystal emulsion in an adjustment vessel to a temperature which is low but not too low to cause the emulsion to gel, and adjusting the emulsion to have such a pAg value as will impart the silver halide fine crystals with a lower solubility. In the invention, the sizes of silver halide fine crystals are 0.05 μm or less, preferably 0.03 m or less, more preferably 0.01 μm or less. Silver halide fine crystals are supplied to a parent liquid tank preferably within 7 hours, more preferably within 2 hours, most preferably within 20 minutes, after their supply to an adjustment vessel.

It is desirable that an adjustment vessel be equipped with a temperature controller, by which the temperature of a silver halide fine crystal emulsion in this vessel is kept constant; specifically, at less than 50° C. or higher, preferably less than 40° C., more preferably less than 35° C., but not less than the setting point of the emulsion. In order to lower the setting point, a gelatin having a smaller molecular weight or a synthetic polymer can be used instead.

An adjustment vessel is further equipped with a monitor for monitoring pAg, pH and other conditions of a silver halide fine crystal emulsion, means of adding pAg and pH control solutions and a flow rate controller. These equipment may be conventional. For instance, an ion selecting electrode or a pH stat can be employed as a pAg/pH monitor. A control valve such as a needle valve may be employed for the control of flow rates.

pAg in the adjustment vessel is controlled as 6 to 11, preferably 7 to 10 and more preferably 8 to 10.

Supply of an aqueous silver salt solution and an aqueous halide solution to a mixer, transfer of a silver halide fine crystal emulsion from a mixer to an adjustment vessel or from an adjustment vessel to a parent liquid tank may be performed by using, for instance, a pump. Silver halide fine crystals may be formed either prior to or simultaneously with the growth of nucleic grains in a parent liquid tank. In the latter case, care must be taken not to supply an excessive amount of silver halide fine crystals to a parent liquid tank. In either case, formation of silver halide fine crystals can be performed independently of the growth of nucleic grains in a parent liquid tank, whereby it is possible to obtain silver halide fine crystals with uniform properties. In this point, the method of the invention should be distinguished from the method disclosed in Japanese Patent O.P.I. Publication No. 183417/1989.

In the invention, silver halide grains can be prepared by any of the acid method, the neutral method and the ammonia method. Silver halide grains to be formed by the method of the invention each may consist of silver chloride, silver bromide, silver iodobromide, silver iodochloride, silver iodobromochloride, or mixtures thereof. Their sizes and size distribution are not limitative. The shape of grains is also not limitative; they may have regular crystalline shapes such as cubic and octahedral shapes, or irregular crystalline shapes such as globular and tabular shapes. Twin crystals may also be possible.

Each grain may be of a uniform structure from center to surface, or may have a layered structure in which the interior portion and the surface portion differ in structure. A latent image may be formed in either the inside or the surface of a grain. Growing of silver halide emulsion grains may be performed in the presence of known solvents for silver halides, such as ammonia, thioether and thiourea. During the formation of silver halide emulsion grains, at least one member selected from salts or complex salts of cadmium, zinc, thallium, iridium, rhodium and iron may be added so that grains each have a metal ion in its inside and/or on its outer surface. By leaving in an adequate reducing atmosphere, each of emulsion grains can have a sensitizing nucleus either in the inside or on the surface.

A silver halide photographic emulsion comprising such emulsion grains may be subjected to desalting, chemical sensitization and spectral sensitization at need. After the addition of various photographically effective additives, the emulsion is applied onto a support to form a light-sensitive layer of a light-sensitive material.

EXAMPLES

The present invention will be described in more detail according to the following examples.

Example 1

Preparation of silver iodobromide seed emulsion 1-A

According to the method described in Japanese Patent O.P.I. Publication No. 45437/1975, to 500 ml of a 2.0 wt % aqueous gelatin solution which had been heated to 40° C., 250 ml of a 4M aqueous silver nitrate solution and 250 ml of an aqueous halide solution containing 3.96M potassium bromideand 0.04M potassium iodide were added by the controlled double-jet method over a period of 35 minutes, while maintaining pAg and pH to 9.0 and 2.0, respectively, where by silver iodide (AgI) grains were formed in the gelatin solution. After adjusting the pH of the gelatin solution to 5.5 with an aqueous potassium carbonate solution, 364 ml of an aqueous 5% solution of Demor N (manufactured by Kao Atlas Co., Ltd.) as a flocculating agent and 244 ml of an aqueous 20% solution of magnesium sulfate as polyvalent ions were added, thereby to allow the grains to flocculate. The mixture was then allowed to stand for a while, causing the grains to be sedimented. The supernatant was removed by decantation, and 1,400 ml of distilled water was added to make the grains re-dispersed. Then, 36.4 ml of an aqueous 20% solution of magnesium sulfate was added for re-flocculation. The mixture was left for while to allow the grains to be sedimented. After the supernatant was removed by decantation, an aqueous solution containing 28 g of ossein gelatin that had been heated to 40° C. was added in such an amount as will make the total quantity 425 ml. The addition was performed over a period of 40 minutes. As a result, a seed emulsion comprising nucleic AgX grains was obtained. This emulsion was designated as 1-A. Observation by anelectron microscope revealed that this emulsion consisted of monodispersed AgX grains with an average grain size of 0.093 um.

Preparation of silver iodobromide core/shell type emulsion 1-B (Comparative)

Using the following seven solutions, an emulsion comprising silver iodobromide core/shell type grains with an average grain size of 0.38 μm and an average AgI content of 8.46% was obtained. In each grain, the AgI contents of the core layer, the intermediate layer and the shell layer were 15 mol %, 5 mol % and 3 mol %, respectively.

| | |
|---|---|
| Solution A | |
| Ossein gelatin | 28.6 g |
| Sodium polyisopropylene disuccinate (a 10% methanol solution) | 16.5 ml |
| 4-Hydroxy-6-methyl-1,3,3a,7-tetrazaindene | 247.5 ml |
| Aqueous 56% acetic acid solution | 72.6 ml |
| Aqueous 28% ammonia solution | 97.2 ml |
| Seed emulsion 1-A | 0.1552 mol in terms of silver |
| Distilled water was added to make the total quantity 6600 ml. | |
| Solution B | |
| Ossein gelatin | 13 g |
| Potassium bromide | 460.2 g |
| Potassium iodide | 113.3 g |
| 4-Hydroxy-6-methyl-1,3,3a,7-tetrazaindene | 665 mg |
| Distilled water was added to make the total quantity 1300 ml. | |
| Solution C | |
| Ossein gelatin | 17 g |
| Potassium bromide | 672.6 g |
| Potassium iodide | 49.4 g |
| 4-Hydroxy-6-methyl-1,3,3a,7-tetrazaindene | 870 mg |
| Distilled water was added to make the total quantity 1700 ml. | |
| Solution D | |
| Ossein gelatin | 8 g |
| Potassium bromide | 323.2 g |
| Potassium iodide | 13.94 g |
| 4-Hydroxy-6-methyl-1,3,3a,7-tetrazaindene | 409 mg |

-continued

| | |
|---|---|
| Distilled water was added to make the total quantity 800 ml. | |
| Solution E | |
| Silver nitrate | 1773.6 g |
| Aqueous 28% ammonia solution | 1740 ml |
| Distilled water was added to make the total quantity 2983 ml. | |
| Solution F | |
| Aqueous 20% potassium bromide solution | Amount required for pAg control |
| Solution G | |
| Aqueous 56% acetic acid solution | Amount required for pH control |

Using the mixer described in Japanese Patent O.P.I. Publication Nos. 92523/1982 and 92524/1982, Solutions E and B were added to Solution A at 40° C. by the double-jet method. Upon completion of the addition of Solution B, Solution C was added. Upon completion of the addition of Solution C, Solution D was added. The pAg and pH of the reaction mixture, and the flow rates of Solutions E, B, C and D were varied with time as shown in Table 1.

Control of pAg and pH was performed by changing the flow rates of Solutions F and G by means of a roller tube pump.

After the addition of Solution E, Ag/pH control, desalting by rinsing, and re-dispersion was performed.

TABLE 1

| | | | Flow rate of solution (ml/min) | | | |
|---|---|---|---|---|---|---|
| Time (minute) | pH | pAg | Solution E | Solution B | Solution C | Solution D |
| 0 | 9.00 | 8.55 | 9.8 | 9.3 | | |
| 7.85 | 8.81 | 8.55 | 30.7 | 29.2 | | |
| 11.80 | 8.63 | 8.55 | 44.9 | 42.7 | | |
| 17.33 | 8.25 | 8.55 | 61.4 | 58.4 | | |
| 19.23 | 8.10 | 8.55 | 63.5 | 60.4 | | |
| 22.19 | 7.88 | 8.55 | 56.6 | 53.8 | | |
| 28.33 | 7.50 | 8.55 | 41.2 | 39.8 | 39.8 | |
| 36.61 | 7.50 | 9.38 | 31.9 | | 34.1 | |
| 40.44 | 7.50 | 9.71 | 30.6 | | 37.1 | |
| 45.14 | 7.50 | 10.12 | 34.6 | | 57.8 | |
| 45.97 | 7.50 | 10.20 | 37.3 | | 36.3 | |
| 57.61 | 7.50 | 10.20 | 57.3 | | 55.8 | 55.8 |
| 63.08 | 7.50 | 10.20 | 75.1 | | | 73.1 |
| 66.63 | 7.50 | 10.20 | 94.0 | | | 91.4 |

Preparation of silver bromide fine crystal emulsion 1-C (Present Invention)

Using the mixer shown in FIG. 2, an emulsion comprising 100% pure silver bromide fine crystals was prepared according to the following method.

| | |
|---|---|
| Solution A | |
| Silver nitrate | 1623.6 g |
| Pure water was added to make the total quantity 2730.7 cc. | |
| Solution B | |
| Potassium bromide (KBr) | 1456 g |
| Pure water was added to make the total quantity 3500 cc. | |
| Solution C | |
| Ossein gelatin | 60 g |
| Sodium polyisopropylene disuccinate (10% methanol solution) | 15 ml |
| 10% Silver nitrate solution | Amount required to adjust pH to 2.0 |
| Pure water was added to make the total | |

-continued

| | |
|---|---|
| quantity 3,000 ml. | |
| Solution D (for pAg control) | |
| Aqueous 20% potassium bromide solution | Amount required for pAg control |
| Solution E (for pH control) | |
| Aqueous 10% anhydrous sodium carbonate solution | Amount required for pH control |

Solutions A, B and C were mixed in a mixing ratio of 9.98:10:4 at 35° C. for 15 minutes. The rotation speed of the stirring blade was 7,000 rpm. The resulting emulsion stayed in the mixer for 4.5 seconds. Observation by a direct transmission-type electron microscope (×70,000) revealed that the crystals formed in the mixer had an average grain size of 0.013 μm. Immediately after the formation, the emulsion was transferred to an adjustment vessel, and stored there for a while. During that time, the temperature of the emulsion was kept at 35° C., and the pAg and pH of the emulsion were controlled to 9 and 5.5, respectively, by adding Solutions D and E. Observation by a transmission-type electron microscope revealed that the average grain size of the silver bromide fine crystals in the adjustment vessel was 0.013 μm.

Preparation of silver iodide fine crystal emulsion 1-D

| | |
|---|---|
| Solution A | |
| Ossein gelatin | 30 g |
| Sodium polyisopropylene disuccinate (10% methanol solution) | 2.5 ml |
| Sodium citrate | 2.5 g |
| Distilled water | 785 ml |
| Solution B | |
| Silver nitrate | 150 g |
| Pure water was added to make the total quantity 252 ml. | |
| Solution C | |
| Potassium iodide (KI) | 176.6 g |

Pure water was added to make the total quantity 304 ml.

Using the mixer described in Japanese Patent O.P.I. Publication Nos. 92523/1982 and 92524/1982, to an aqueous protective colloid solution that had been heated to 40° C., Solutions B and C were added by the controlled double-jet method over a period of 25 minutes, thus forming AgI crystals. Observation by an electron microscope revealed that these crystals had an average grain size of 0.05 μm.

Preparation of silver iodobromide core/shell type emulsion

1-E (Comparative)

Using the following solutions, an emulsion comprising silver iodobromide core/shell type grains having an average grain size of 0.38 μm and an average AgI content of 8.46 mol % was prepared. The halogen compositions of the grains were identical with those of the grains contained Emulsion 1-B.

| | |
|---|---|
| Solution A | |
| Ossein gelatin | 28.6 g |
| Sodium polyisopropylene disuccinate (10% methanol solution) | 16.5 ml |
| 4-Hydroxy-6-methyl-1,3,3a,7-tetrazaindene | 247.5 mg |
| Aqueous 56% acetic acid solution | 72.6 ml |

-continued

| | |
|---|---|
| Aqueous 28% ammonia solution | 97.2 ml |
| Seed emulsion 1-A | 0.1552 mol in terms of silver |
| Distilled water was added to make the total quantity 6,600 ml. | |
| Solution B | |
| Silver nitrate | 1773.6 g |
| Water was added to make the total quantity 2983 ml. | |
| Solution C | |
| Potassium bromide | 460.2 g |
| Potassium iodide | 113.3 g |
| 4-Hydroxy-6-methyl-1,3,3a,7-tetrazaindene | 665 mg |
| Distilled water was added to make the total quantity 1,300 ml. | |
| Solution C | |
| Potassium bromide | 672.6 g |
| Potassium iodide | 49.4 g |
| 4-Hydroxy-6-methyl-1,3,3a,7-tetrazaindene | 870 mg |
| Distilled water was added to make the total quantity 1,700 ml. | |
| Solution D | |
| Potassium bromide | 323.2 g |
| Potassium iodide | 13.94 g |
| 4-Hydroxy-6-methyl-1,3,3a,7-tetrazaindene | 409 mg |
| Distilled water was added to make the total quantity 800 ml. | |
| Solution E | |
| Ossein gelatin | 60 g |
| Sodium polypropylene disuccinate (10% methanol solution) | 5 ml |
| Pure water was added to make the total quantity 2,000 ml. | |
| Solution F | |
| Aqueous 20% potassium bromide solution | Amount required for pAg control |
| Solution G | |
| Aqueous 28% ammonia solution | Amount required for pH control |

Solution A was introduced into a parent liquid tank, and the pAg and pH of the mixture were adjusted to 8.5 and 7.5, respectively, with Solutions F and G. Solutions B, C, D and E were added functionally by the triple-jet method to the mixer shown in FIG. 2, which was provided outside the parent liquid tank. The addition was lasted for 60 minutes. The flow rates of the solutions were controlled in such a manner as would make the AgI contents of the core layer, the intermediate layer and the shell layer of each grain 15 mol %, 5 mol % and 3 mol %, respectively. During the grain formation, the pH of the reaction mixture was controlled in the same manner as in the preparation of Emulsion 1-B. The emulsion stayed in the mixer for 7 seconds. The temperature of the mixer was kept at 35° C., and the rotation speed of the stirring blade of the mixer was 7,000 rpm. The fine crystals formed in the mixer were supplied to the parent liquid tank continuously, where they were consumed for the growth of emulsion grains. Observation by an electron microscope revealed that the grains formed in the parent liquid tank had an average grain size of 0.38 μm and had the same crystal structure as that of the grain in Emulsion 1-B. Meanwhile, observation by a direct transmission-type electron microscope revealed that the sizes of the crystals formed in the mixer were in the range of 0.016 to 0.012 μm. The so-formed emulsion was designated as Emulsion 1-E. In the same manner as in the preparation of Emulsion 1-B, Emulsion 1-E was subjected to desalting by rinsing and to re-dispersion.

Preparation of silver iodobromide core/shell type emulsion

1-F (Present Invention)

Using the following solutions, an emulsion comprising silver iodobromide core/shell type grains having an average grain size of 0.38 μm and an average AgI content of 8.46 mol % was obtained. The grains had the same halogen compositions as those of the grains in Emulsion 1-B.

| | |
|---|---|
| Solution A | |
| Ossein gelatin | 28.6 g |
| Sodium polyisopropylene disuccinate (10% methanol solution) | 16.5 ml |
| 4-Hydroxy-6-methyl-1,3,3a,7-tetrazaindene | 247.5 mg |
| Aqueous 56% acetic acid solution | 72.6 ml |
| Aqueous 28% ammonia solution | 97.2 ml |
| Seed emulsion (1-A) | 0.1552 mol in terms of silver |
| Distilled water was added to make the total quantity 6,600 ml. | |
| Solution B | |
| Emulsion 1-C | 9.56 mols in terms of silver |
| 4-Hydroxy-6-methyl-1,3,3a,7-tetrazaindene | 335 mg |
| Solution C | |
| Emulsion 1-D | 0.88 mol in terms of silver |
| 4-Hydroxy-6-methyl-1,3,3a,7-tetrazaindene | 200 mg |
| Solution D | |
| Aqueous 20% potassium bromide solution | Amount required for pAg control |
| Solution E | |
| Aqueous 28% ammonia solution | Amount required for pH control |

Solution A was introduced into a parent liquid tank. Solutions D and E were added at 40° C. so that the pAg and pH of the reaction mixture were adjusted to 8.5 and 7.5, respectively. Then, about 2 hours after their formation, Solutions B and C were added to the parent liquid tank by the double-jet method over a period of 55 minutes. The average grain sizes of Emulsions 1-C (Solution B) and Emulsion 1-D (Solution C) were found to be 0.014 μm and 0.06 μm, respectively, as measured immediately after their formation. The flow rates of Solutions B and C were controlled functionally for 25 minutes, 23 minutes and 12 minutes, so that the AgI contents of the core layer, the intermediate layer and the shell layer became 15 mol %, 5 mol % and 3 mol %, respectively.

Observation by an electron microscope revealed that the grains contained in the so-formed Emulsion 1-F had an average grain size of 0.38 μm and had the same crystal structure as that of the grains contained in Emulsion 1-B. This emulsion was subjected to rinsing for desalting and re-dispersion treatment in the same manner as in the preparation of Emulsion 1-B.

Emulsions 1-B, 1-E and 1-F were each subjected to gold/sulfur sensitization. Then, using 550 mg (per mol AgI) of Sensitizing dye 1 and 340 mg (per mol AgI) of Sensitizing dye 2, each emulsion was spectrally sensitized to green, followed by addition of 4-hydroxy-6-methyl- 1,3,3a,7-tetrazaindene and 1-phenyl-5-mercaptotetrazole for stabilization.

Magenta coupler M-1 was dissolved in a mixture of ethyl acetate and dinonyl phthalate, and the resulting solution was dispersed in an aqueous gelatin solution. The so-formed coupler dispersion, as well as other photographic additives such as a spreader and a hardener, were added to each emulsion to obtain coating liquids. Each of these coating liquids was applied onto a subbed support in the usual way, followed by drying, whereby three samples of light-sensitive material were obtained. The amounts of the ingredients (per square meter of a light-sensitive material) were given below:

| | |
|---|---|
| Emulsion | 1 g |
| Magenta coupler M-1 | 0.4 g |
| Dinonyl phthalate | 0.4 g |
| Gelatin | 0.12 g |

Sensitizing dye 1

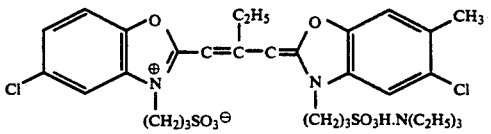

Sensitizing dye 2

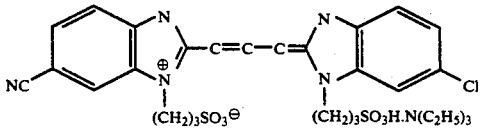

Magenta coupler M-1

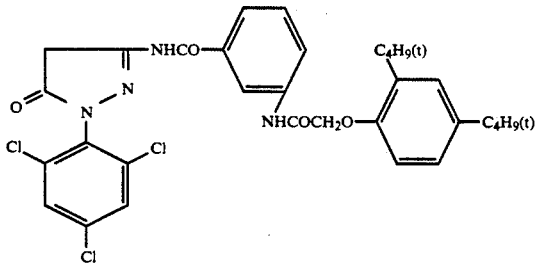

Each sample was exposed to light through an optical wedge in the usual way, and processed according to the following procedures.

| | |
|---|---|
| Color developing | 3 min 15 sec |
| Bleaching | 6 min 30 sec |
| Rinsing | 3 min 15 sec |
| Fixing | 6 min 30 sec |
| Rinsing | 3 min 15 sec |
| Stabilizing | 1 min 30 sec |
| Drying | |

The compositions of the processing liquids are given below.

| | |
|---|---|
| (Color developer) | |
| 4-Amino-3-methyl-N-(β-hydroxyethyl)-aniline sulfate | 4.75 g |
| Anhydrous sodium sulfite | 4.25 g |
| Hydroxylamine 1/2 sulfate | 2.00 g |
| Anhydrous potassium carbonate | 37.50 g |
| Potassium bromide | 1.30 g |
| Trisodium nitrilotriacetate (monohydrate) | 2.50 g |
| Potassium hydroxide | 1.00 g |
| Water was added to make the total quantity 1,000 ml. | |
| (Bleacher) | |
| Ferric ammonium ethylenediamine tetraacetate | 100.0 g |
| Diammonium ethylenediamine teteraacetate | 10.0 g |
| Ammonium bromide | 150.0 g |
| Glacial acetic acid | 10.0 g |
| Water was added to make the total quantity | |

-continued

| | |
|---|---|
| 1,000 ml | |
| and pH was adjusted to 6.0 with aqueous ammonia. | |
| (Fixer) | |
| Ammonium thiosulfate | 175.0 g |
| Anhydrous ammonium sulfite | 8.6 g |
| Sodium metasulfite | 2.3 g |
| Water was added to make the total quantity 1,000 ml | |
| and pH was adjusted to 6.0 with acetic acid. | |
| (Stabilizer) | |
| Formalin (an aqueous 37% solution) | 1.5 ml |
| Konidax (manufactured by Konica Corp) | 7.5 ml |
| Water was added to make the total quantity 1,000 ml. | |

Figure 4:
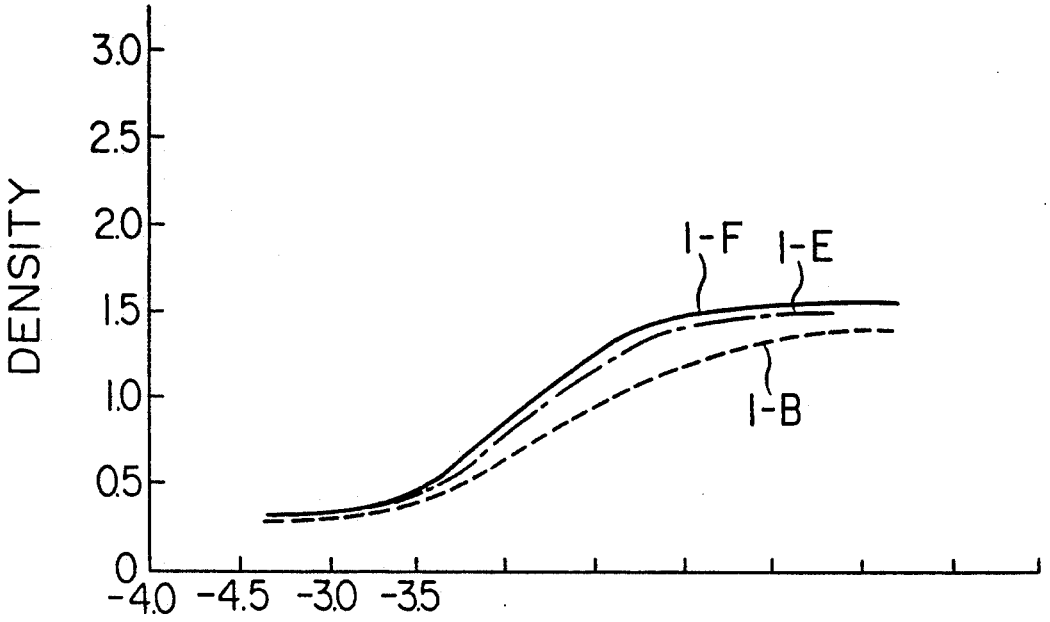
FIG. 4 is a characteristics curve of a light-sensitive material obtained by the invention.

The characteristics curves of these samples are shown in FIG. 4. Table 2 compares the photographic properties of these samples.

TABLE 2

| Emulsion | Relative sensitivity | Fogging density | Remarks |
|---|---|---|---|
| 1-B | 100 | 0.19 | Comparative |
| 1-E | 210 | 0.15 | Comparative |
| 1-F | 230 | 0.13 | Invention |

As is evident from Table 2, the sample of the invention had a sensitivity higher than those of the comparative samples. Further, the sample of the invention was almost free from fogging. The comparative sample that contained Emulsion 1-E had a fogging density relatively lower. The elimination of fogging attained in the sample of the invention and the comparative sample containing Emulsion 1-E was obviously due to the use of silver halide fine crystals for the growth of emulsion grains. However, it is to be noted that the fogging density of the sample containing Emulsion 1-E was higher than that of the sample of the invention. The following conclusion can be drawn from this result: In the preparation of Emulsion 1-E, the conditions under which the formation of fine crystals was performed were caused to vary with changes in the flow rates of silver salt and halide solutions. Therefore, some silver halide fine crystals were formed at a condition where silver ions were present at a high concentration (a low pAg condition). These crystals were caused to have reduced silver nuclei, which grew into fog center in the emulsion grains, causing a photographic image prepared from this emulsion to be fogged.

Example 2

Preparation of silver iodobromide seed emulsion 2-A

A silver iodobromide emulsion with an average AgI content of 2.0 mol % was prepared by the double-jet method in substantially the same manner as in the preparation of Emulsion 1-A, except that pH was kept at 8.0. The formed emulsion was rinsed with water to remove excessive salts. The grains contained in this emulsion had an average grain size of 0.8 μm and a size variation coefficient (standard deviation/average grain size) of 17%.

Preparation of silver iodobromide core/shell type seed emulsion 2-B

In substantially the same manner as in the preparation of Emulsion 1-B, an emulsion comprising silver iodobromide core/shell type grains with an average grain size of 2.2 μm was prepared using the following solutions. The preparation took 130 minutes. Each of the grains had an iodine-rich core layer having a silver iodide content of 25 mol % and a shell layer consisting only of silver bromide. The thickness ratio of the core to the shell was 1:1

| | |
|---|---|
| Solution A | |
| Ossein gelatin | 46.55 g |
| Sodium polyisopropylene disuccinate (10% methanol solution) | 15 ml |
| 4-Hydroxy-6-methyl-1,3,3a-7-tetrazaindene | 750 ml |
| Aqueous 56% acetic acid solution | 441 ml |
| Aqueous 28% ammonia solution | 703 ml |
| Seed emulsion (2-A) | 0.6778 mol in terms of silver |
| Distilled water was added to make the total quantity 12000 ml. | |
| Solution B | |
| Ossein gelatin | 15 g |
| Potassium bromide | 527.8 g |
| Potassium iodide | 245.4 g |
| 4-Hydroxy-6-methyl-1,3,3a-7-tetrazaindene | 1.2 g |
| Distilled water was added to make the total quantity 1690 ml. | |
| Solution C | |
| Ossein gelatin | 20 g |
| Potassium bromide | 962.2 g |
| 4-Hydroxy-6-methyl-1,3,3a-7-tetrazaindene | 1.6 g |
| Distilled water was added to make the total quantity 2300 ml. | |
| Solution D | |
| Silver nitrate | 1684.8 g |
| Aqueous 28% ammonium solution | 1373 ml |
| Distilled water was added to make the total quantity 2833 ml. | |
| Solution E | |
| Aqueous 20% potassium bromide solution | Amount required for pAg control |
| Solution F | |
| Aqueous 56% acetic acid solution | Amount required for pH control |

At 40° C., Solution A was introduced to a parent liquid tank. After adjusting pAg and pH to 8.9 and 9.0, respectively, Solutions B and C where added by the double-jet method over a period of 100 minutes. Upon completion of the addition of Solution C, Solution D was added to form a shell layer in each grain. The grains obtained were octahedral core/shell type grains with an average grain size of 2.18 μm.

Preparation of silver iodobromide emulsion 2-C (Comparative)

Silver iodobromide emulsion 2-C was prepared in accordance with the method described in Japanese Patent O.P.I. Publication No. 183417/1989; to 1200 cc of a 3.0 wt % gelatin solution containing 0.06M potassium bromide that had been put in a parent liquid tank, 80 ml of a 0.1% methanol solution of 3,4-dimethyl-2-thione was added with stirring, and the resulting mixture was kept at 75° C. Then, 50 ml of a 0.3M silver nitrate solution and 50 ml of an aqueous halide solution containing 0.063M potassium iodide and 0.19M potassium bromide were added to the parent liquid tank by the double-jet method over a period of 3 minutes, whereby silver iodobromide grains with an average grain size (here, the size of the grain is defined as the diameter of a circle having the same area as that of the projected image of the grain) of 0.3 μm and an average silver iodide content of 25 mol % were obtained. The so-obtained grains were nucleic grains. Meanwhile, 800 ml of 1.5M silver nitrate, 800 ml of an aqueous halide solution containing 0.375M potassium iodide and 1.13M potassium bromide and 800 ml of an aqueous 3 wt % gelatin solution were introduced to a mixer by the triple-jet method over a period of 100 minutes, whereby silver iodobromide fine crystals were obtained. The fine crystals stayed in the mixer for 7 seconds. The rotation speed of the stirring blade of the mixer was 7000 rpm. Observation by a transmission-type electron microscope revealed that the average size of the crystals was 0.017 μm at the initial stage of the addition, but was 0.013 μm immediately before the completion of the addition. The temperature of the mixer was kept at 35° C. The so-formed crystals were continuously introduced to the parent liquid tank of which the temperature was kept at 75° C. Then, an aqueous 1.5M silver nitrate solution, an aqueous 1.5M potassium bromide solution and an aqueous 2 wt % gelatin solution were mixed for 50 minutes in the mixer, thereby forming grains with an average size of 0.02 μm. The grains were incorporated into the parent liquid tank so that each nucleic grain could have a shell layer consisting of silver bromide. As a result, silver iodobromide octahedral core/shell type grains (thickness ratio of core to shell=1:1) with an average grain size (the grain size is as defined above) of 2.2 μm were obtained. The core layer of each grain had an AgI content of 25 mol %.

Preparation of silver bromide fine crystal emulsion 2-D (present invention)

Using the mixer shown in FIG. 2, emulsions each consisting only of silver bromide fine crystals (Emulsions 2-D-1 to 4) were prepared by the method described below.

| | |
|---|---|
| Solution A | |
| Silver nitrate | 1684.8 g |
| Pure water was added to make the total quantity 2833 ml. | |
| Solution B | |
| Potassium bromide | 1249.5 g |
| Pure water was added to make the total quantity 3000 ml. | |
| Solution C | |
| Ossein gelatin | 50 g |
| Sodium polyisopropylene succinate (10% methanol solution) | 15 ml |
| 10% Nitric acid | Amount required for controlling pH to 2.0 |
| Pure water was added to make the total quantity 1500 ml. | |
| Solution D (for pAg control) | |
| 20% Potassium bromide | Amount required for pAg control |
| Solution E (for pH control) | |
| Aqueous 10% anhydrous sodium carbonate solution | Amount required for pH control |

Emulsion 2-D-1 was formed by mixing Solutions A, B and C at 35° C. for 15 minutes with a mixing ration of 9.98:10:4. The rotation speed of the stirring blade of the mixer was 7000 rpm. The emulsion stayed in the mixer for 4.5 seconds. Observation by a direct transmission-type electron microscope (×70,000) revealed that the grains in the emulsion had an average size of 0.013 μm. The emulsion was then transferred to an adjustment vessel, and stored there for a while. In the adjustment vessel, the pAg and pH of the emulsion were controlled to 9 and 5.5, respectively, by adding Solutions D and E. Observation by a transmission-type electron microscope revealed that the silver bromide grains in the adjustment vessel had an average size of 0.013 μm.

Emulsions 2-D-2 to 4 were prepared in substantially the same manner as in the preparation of Emulsion 2-D-1, except that the conditions of the emulsion were adjusted as shown in Table 3. The grains contained in these emulsions had the same average grain size as that of Emulsion 2-D-1.

TABLE 3

| | Liquid conditions | |
|---|---|---|
| Emulsion | pAg | pH |
| 2-D [1] | 9.0 | 5.5 |
| 2-D [2] | 11.0 | 5.5 |
| 2-D [3] | 3.0 | 6.3 |
| 2-D [4] | 2.0 | 6.3 |

Figure 5:
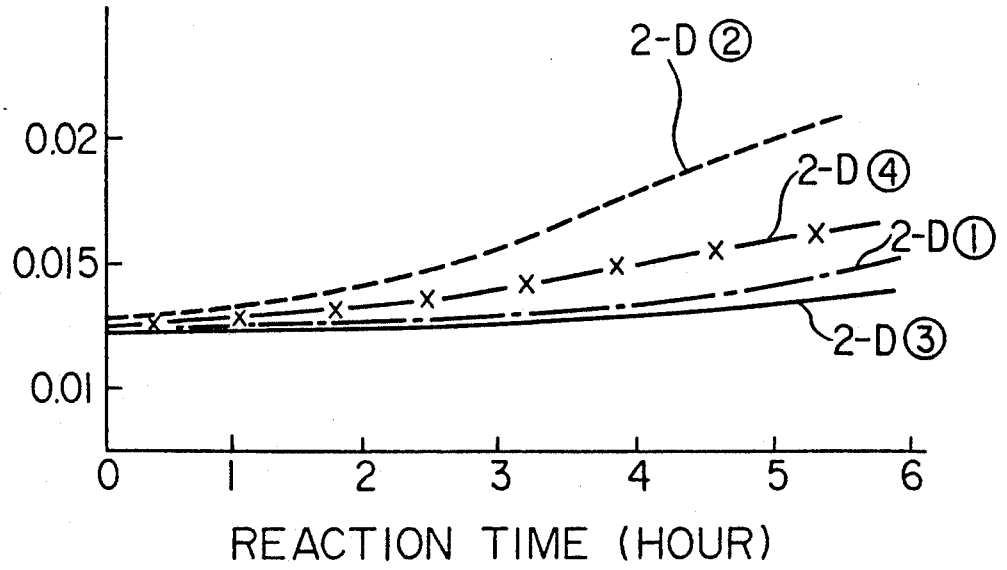
FIG. 5 is a graph showing the change in the sizes of silver halide fine crystals in an adjustment vessel with the passage of time.

Each of the above-obtained emulsions was kept at 35° C. in the adjustment vessel with stirring. Observation by an electron microscope was made to examine how the sizes of the crystals changed with the lapse of time. The results of this examination was shown in FIG. 5. As is evident from FIG. 5, silver halide fine crystals can be prevented from undergoing the Ostwald's ripening or agglomeration, and as result, can keep their sizes almost constant when the emulsion containing them are adjusted to have a pAg value at which silver bromide exhibits a poor solubility.

Preparation of silver iodide fine crystal emulsion 2-E (present invention)

Using the same mixer as that employed in the preparation of Emulsions 2-D-1 to 4, a silver iodide fine crystal emulsion was prepared from the following solutions. The preparation of the emulsion took 15 minutes. The formed emulsion was sent to an adjustment vessel, where its pAg and pH were adjusted to 10.0 and 6.5, respectively. The average size of the crystals was 0.011 μm.

| | |
|---|---|
| Solution A | |
| Ossein gelatin | 28.78 g |
| Sodium polyisopropylene succinate (10% methanol solution) | 16.5 cc |
| Sodium citrate | 2.4 g |
| Distilled water | 5287 cc |
| Solution B | |
| Silver nitrate | 180 g |
| Pure water was added to make the total quantity 303 ml. | |
| Solution C | |
| Potassium iodide | 249 g |
| Pure water was added to make the total quantity 428 ml. | |

Preparation of silver iodobromide core/shell type emulsion 2-F (present invention)

Using the following solutions, Emulsions 2-F-1 to 4 each comprising core/shell type silver iodobromide grains with an average grain size of 2.2 μm were prepared. Each grain had the same crystal structure as that of the grain contained in Emulsion 1-B

| | |
|---|---|
| Solution A | |
| Ossein gelatin | 46.55 g |
| Sodium polyisopropylene succinate (10% methanol solution) | 15 ml |

-continued

| | |
|---|---|
| 4-Hydroxy-6-methyl-1,3,3a-7-tetrazaindene | 750 ml |
| Aqueous 56% acetic acid solution | 441 ml |
| Aqueous 28% ammonia solution | 703 ml |
| Seed emulsion (2-A) | 0.6778 mol in terms of silver |
| Distilled water was added to make the total quantity 12000 ml. | |
| Solution B | |
| Emulsion 2-D-1 | 6.6 mols in terms of silver |
| 4-Hydroxy-6-methyl-1,3,3a-7-tetraindene | 600 mg |
| Solution C | |
| Emulsion 1-E | 5.9 mols in terms of silver |
| 4-Hydroxy-6-methyl-1,3,3a-7-tetrazaindene | 380 mg |
| Solution D | |
| Aqueous 20% potassium bromide solution | Amount required for pAg control |
| Solution E | |
| Aqueous 28% ammonia | Amount required for pAg control |

Solution A was introduced into a parent liquid tank, heated to 40° C., and at which temperature, adjusted to have pAg and pH values of 8.5 and 7.5, respectively, with Solutions D and E. Then, Solutions B and C, 4 hours after their formation, were added to Solution A by the double-jet method over a period of 120 minutes. Emulsions 2-D-1 (Solution B) and Emulsion 2-E had average grain sizes of 0 014 μm and 0.012 μm, respectively, as measured immediately after their formation. The addition of Solutions B and C was performed in such a manner that Solution B was added for the first 90 minutes to form cores with an AgI content of 25 mol %, and then Solution C was added for the remaining 30 minutes to form shells.

Electron microscopic observation revealed that the so-obtained emulsion grains had an average grain size of 2.2 μm and each had the same crystal structure as that of the grain contained Emulsion 2-B. This emulsion was then subjected to rinsing for desalting and to re-dispersion.

Emulsions 2-F-2 to 4 were prepared in substantially the same manner as in the preparation of Emulsion 2-F-1, except that Solution B was changed to those shown in Table 4. The properties of the grains in these emulsions are summarized in Table 4.

TABLE 4

| Emulsion | Solution B | Properties of grains |
|---|---|---|
| 2-F [1] | 2-D [1] | Octahedral grains with an average size of 2.2 μm and a variation coefficient of 16% |

TABLE 4-continued

| Emulsion | Solution B | Properties of grains |
|---|---|---|
| 2-F [2] | 2-D [2] | Small grains were formed |
| 2-F [3] | 2-D [3] | Octahedral grains with an average size of 2.2 μm and a variation coefficient of 17.5% |
| 2-F [4] | 2-D [4] | Small grains were formed |

In the case of Emulsions 2-F-2 and 4, silver bromide crystals with a poor solubility due to their relatively large grain sizes were supplied as Solution B, and these crystals were caused to grow during the growth of nucleic grains, resulting in the formation of small grains. In contrast, in the case of Emulsions 2-F-1 and 3, the sizes of the silver bromide crystals employed as Solution B were kept small though 4 hours were lapsed after their formation. Therefore, these silver bromide crystals exhibited a high solubility, and were eventually prevented from affecting adversely the growth of nucleic grains.

Each of Emulsions 2-B, 2-F-1 and 3 was sensitized in substantially the same manner as in Example 1, except that the sensitizing dyes were varied to those shown below. The amount of each sensitizing dye was 15 mg per mol silver.

Sensitizing dye 3

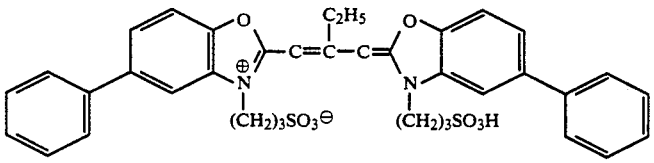

Sensitizing dye 4

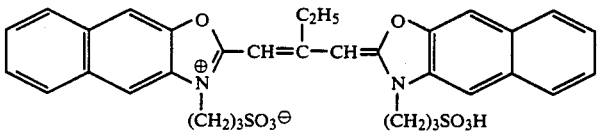

The sensitized emulsions were each applied onto a subbed support, and dried in the usual way, thus obtaining silver halide light-sensitive material samples. Each sample was subjected to exposure, and then to processing in the same manner as in Example 1.

Emulsion 2-C was chemically sensitized to an optimum level with sodium thiocyanate and potassium chloroaurate, and then spectrally sensitized by the method described in Japanese Patent O.P.I. Publication No. 183417/1989. The emulsion was then subjected to exposure and processing in the same manner as in Example 1.

Table 5 compares the photographic properties of these samples.

TABLE 5

| Emulsion | Relative sensitivity | Fogging density | Remarks |
|---|---|---|---|
| 2-B | 100 | 0.20 | Comparative |
| 2-C | 210 | 0.13 | Comparative |
| 2-F [1] | 200 | 0.18 | Invention |
| 2-F [3] | 230 | 0.12 | Invention |

As is evident from Table 5, Emulsion 2-F-1 of the invention had a higher sensitivity and a lower fogging sensitivity as compared with the comparative emulsions. Fogging was eliminated by the use of silver halide fine crystals. The fogging sensitivities of Emulsions 2-C and 2-F-3 were, however, relatively high even though they were prepared by using silver halide fine crystals. In the case of Emulsion 2-C, the formation of silver halide fine crystals in a mixer could not be performed at fixed conditions due to changes in the flow rates of silver salt and halide solutions, allowing some fine crystals to be formed at a condition where the silver ion concentration was high (pAg was low). In the case of Emulsion 2-F-3, since the silver halide fine crystal emulsion had such a low pAg value as 3.0, a reduced silver nucleus was formed in each crystal. Such reduced silver nucleus became a fogging nucleus in the growing nucleic grain, causing a photographic image obtained from Emulsion 2-F-3 to be fogged. As is apparent from the foregoing, by adjusting the liquid conditions of a silver halide fine crystal emulsion before supplying it to a parent liquid tank, it is possible to supply to the parent liquid tank silver halide fine crystals of which the sizes are small enough and do not differ from crystal to crystal, and as a result, possible to obtain highly-sensitive silver halide emulsion grains.

The present invention has solved the problems accompanying the conventional method and apparatus; i.e., silver halide grains must be grown at a condition where the concentration of silver and halide ions cannot be kept constant, and as a result, silver halide emulsion grains lacking uniformity in size, crystal structure and halogen composition tend to be formed. Further, by the use of an adjustment vessel where the conditions of silver halide fine crystals (temperature, pAg) are suitably adjusted, it has become possible to prevent the silver halide fine crystals from changing their sizes even when they are stored for a while before being supplied to a parent liquid tank. In addition, such pAg adjustment prevents a reduced silver nuclei from being formed in each crystal, thus permitting the formation of silver halide grains which are remarkably improved in sensitivity and free from fogging.

What is claimed is:

1. A method for preparing silver halide grains for a photographic emulsion comprising the steps of:

(a) mixing an aqueous silver salt solution, an aqueous halide solution and an aqueous protective colloid solution in a mixer provided outside a parent liquid tank to produce a first emulsion comprising silver halide fine grains;

(b) transferring said first emulsion to an adjustment vessel;

(c) adjusting the pAg of said first emulsion to a prescribed value of pAg in the adjustment vessel to produce a pAg adjusted emulsion; and (d) supplying said pAg adjusted emulsion to a second emulsion comprising nucleic grains in the parent liquid tank to produce said silver halide grains.

2. A silver halide photographic material produced by the method of claim 1.

3. The method of claim 1, wherein the mixer is provided with a stirring blade which rotation speed is higher than 10000 rpm.

4. The method of claim 1, wherein the adjustment vessel is provided with a monitor for monitoring pAg and pH, signals of which control supply adjusment devices for liquids supply for supplying an appropriate amounts of the liquids.

5. The method of claim 1, wherein the pAg of said first emulsion is adjusted to 6 to 11.

6. The method of claim 5, wherein the pAg of said first emulsion is adjusted to 8 to 10.

7. The method of claim 1, wherein an average size of the silver halide fine grains is less than 0.01 μm.

8. The method of claim 1, wherein the first emulsion stays in the adjustment vessel for less than 7 hours at lower than 35° C.

9. The method of claim 1, further comprising the step of adjusting the pH of said pAg adjusted emulsion to a prescribed value of pH in the adjustment vessel.

10. A method of preparing silver halide grains for a photographic emulsion comprising steps of:

(a) mixing an aqueous silver salt solution, an aqueous halide solution and an aqueous protective colloid solution in a mixer provided outside of a parent liquid tank, forming fine silver halide grains, in a condition of pAg not less than 3, pH not more than 10 and $[Ag^+]$ $[OH^-]$ not more than $10^{-10}$;

(b) the fine silver halide grains being stored in an adjustment vessel for conditioning the fine silver halide grains suspended in a liquid, as a fine-grain-suspended-solution, (c) the fine-grain-suspended-solution being supplied to the parent liquid tank in which silver halide grains are seperately formed in a protecive coloidal solution and the silver halide grains seperately formed in the parent liquid tank are grown by the fine silver halide grains formed in the mixer.

11. A silver halide photographic material produced by the method of claim 10.

* * * * *